US005779526A

United States Patent [19]

Gill

[11] Patent Number: 5,779,526

[45] Date of Patent: Jul. 14, 1998

[54] PAD CONDITIONER

[76] Inventor: Gerald L. Gill, 1812 Peaceful Mesa, Prescott, Ariz. 85301

[21] Appl. No.: 622,265

[22] Filed: Feb. 27, 1996

[51] Int. Cl.[6] ..... B24B 53/00

[52] U.S. Cl. ..... 451/324; 451/56; 451/443; 451/444; 451/242

[58] Field of Search ..... 451/56, 443, 444, 451/324, 231, 242, 246, 254, 258

[56] References Cited

U.S. PATENT DOCUMENTS

| | | | |
|---|---|---|---|
| 5,081,051 | 1/1992 | Mattingly et al. | 451/56 |
| 5,216,843 | 6/1993 | Breivogel et al. | 451/56 |
| 5,456,630 | 10/1995 | Kaiser et al. | 451/443 |
| 5,486,131 | 1/1996 | Cesna et al. | 451/56 |
| 5,531,635 | 7/1996 | Mogi et al. | 451/56 |
| 5,547,417 | 8/1996 | Breivogel et al. | 451/443 |

FOREIGN PATENT DOCUMENTS 1140959 6/1989 Japan .

*Primary Examiner*—Eileen P. Morgan
*Attorney, Agent, or Firm*—Tod R. Nissle, P.C.

[57] ABSTRACT

Polishing apparatus cuts and shapes a polishing pad to produce a polishing surface which minimizes pad runout and which can be contoured to better achieve desired polishing rates, pressures, and performance with respect to selected areas on a semiconductor wafer being processed with the polishing pad.

16 Claims, 11 Drawing Sheets

PAD CONDITIONER

This invention relates to apparatus for conditioning polishing pads.

More particularly, the invention relates to apparatus for cutting and/or abrading a polishing pad to produce a polishing surface used to process semiconductor wafers and other objects.

In a further respect, the invention relates to apparatus for cutting and shaping a polishing pad to produce a polishing surface which minimizes pad runout and which can be contoured to better achieve desired polishing rates, pressures, and performance with respect to selected areas on a semiconductor wafer being processed with the polishing pad.

Pads which are utilized to polish semiconductor wafers gradually become, in use, impregnated with old or used abrasive particulate and other waste material. A polishing pad also exhibits wear at the points at which a wafer contacts the pad. The use of brushes and knife-type blades to remove such waste material from and renew the surface of polishing pads is well known in the art. See, for example, U.S. Pat. Nos. 5,081,051 to Mattingly et al. (serrated blade to remove waste material from pad), 5,216,843 to Breivogel et al. (diamond tips to form parallel grooves in polishing pad), 4,121,313 to Mayer (roller tool which uses studs and pressurized air to loosen cleaning compound from polishing pad), 5,329,734 to Yu (perforated polishing pad), 5,154,021 to Bombardier et al. (pressurized air to clean polishing pad), 5,072,475 to Rubiano (rotating teeth and pressurized air to clean polishing pad), and 4,466,218 to Ottman et al. (pads used to polish magnetic disk).

Many prior art pad conditioners are pressed against a polishing pad by a control arm which can move up and down with the polishing pad. The polishing pad moves up and down because the polishing surface of the pad is not at a right angle to the rotating spindle which supports the circular platin crying the polishing pad. Instead, the polishing pad and often the platin are canted at a slight angle with respect to the rotating spindle. The canting of the polishing surface with respect to the axis of rotation of the spindle is called runout. Manufacturing tolerances, assembly variations, and variances in pad thickness and uniformity all contribute to the existence of runout and to variations in the polishing surface. Runout is undesirable because at high spindle rotation speeds, it interacts with other structural characteristics inherent in the polishing equipment to cause variations in the pressure produced by the polishing surface against a semiconductor wafer. For example, variations in the pressure produced by the polishing surface against a wafer are caused by the inability of a semiconductor wafer to follow the vertical movement of runout due to the mass (inertia) of the polishing head or due to frictional forces in the polishing equipment which resist the vertical displacement of the polishing head.

Another disadvantage of some prior art polishing pad conditioners is that they can only produce a substantially flat polishing surface. The distribution and concentration of polishing forces over selected areas on the surface of a semiconductor wafer could be enhanced if a means were provided to produce a contoured polishing pad surface.

Yet another disadvantage of some prior art polishing pad conditioners is that they are designed simply to roughen the surface of a polishing pad and are not designed to produce a desired flat or contoured polishing pad surface.

Accordingly, it would be highly desirable to provide a polishing pad conditioner which would minimize or eliminate runout and which could contour a polishing pad such that the pad would produce desired differing or equivalent polishing pressures against selected areas of a semiconductor wafer subsequently polished by the polishing pad.

Therefore, it is a principal object of the invention to provide improved apparatus for conditioning a polishing pad.

A further object of the invention is to provide improved apparatus which can be utilized to shape a polishing pad to minimize or substantially eliminate pad runout.

Another object of the instant invention is to provide improved apparatus which can shape and dimension a polishing pad to provide a desired pressure gradient over the surface of a semiconductor wafer subsequently contacted by the polishing pad.

These and other, further and more specific objects and advantages of the invention will be apparent to those skilled in the art from the following detailed description thereof, taken in conjunction with the drawings, in which.

Briefly, in accordance with my invention, I provide improved apparatus for conditioning polishing pad apparatus. The polishing pad apparatus includes a table having an upper surface; a polishing pad mounted on the upper surface of the table; a frame to rotatably support the table in a selected orientation with respect to the frame to rotate about an axis substantially normal to the upper surface of the table; and, a motor to rotate the table about the axis. The improvement comprises conditioning apparatus to cut the pad to minimize the runout of the pad. The conditioning apparatus includes an elongate tool for cutting the pad means to form a polishing surface; and, apparatus for attaching the tool to the frame such that the tool can be placed and held in selected known fixed orientations with respect to the axis while the tool cuts the pad to form a polishing surface on the pad such that each point on the polishing surface which is equidistant from the axis is also equidistant from an imaginary plane normal to the axis. In another embodiment of my invention, I provide improved apparatus for conditioning polishing pad apparatus. The polishing pad apparatus includes a table having an upper surface; a polishing pad mounted on the upper surface of the table; a frame to rotatably support the table in a selected orientation with respect to the frame to rotate about an axis substantially normal to the upper surface of the table; and, a motor to rotate the table about the axis. The improvement comprises conditioning apparatus to contour the pad. The conditioning apparatus includes an elongate tool for cutting the pad means to form a polishing surface; and, apparatus for holding the tool in selected known fixed orientations with respect to the axis while the tool cuts the pad to form a polishing surface on the pad. The apparatus holds the tool in selected orientations such that each point on the polishing surface which is a first selected distance from the axis is also a second selected distance from an imaginary plane normal to the axis; and, such that each point on the polishing surface which is at a third selected distance from the axis is also at a fourth selected distance from an imaginary plane normal to the axis. The third selected distance is different from the first selected distance. The fourth selected distance is different from the second selected distance.

Figure 1:
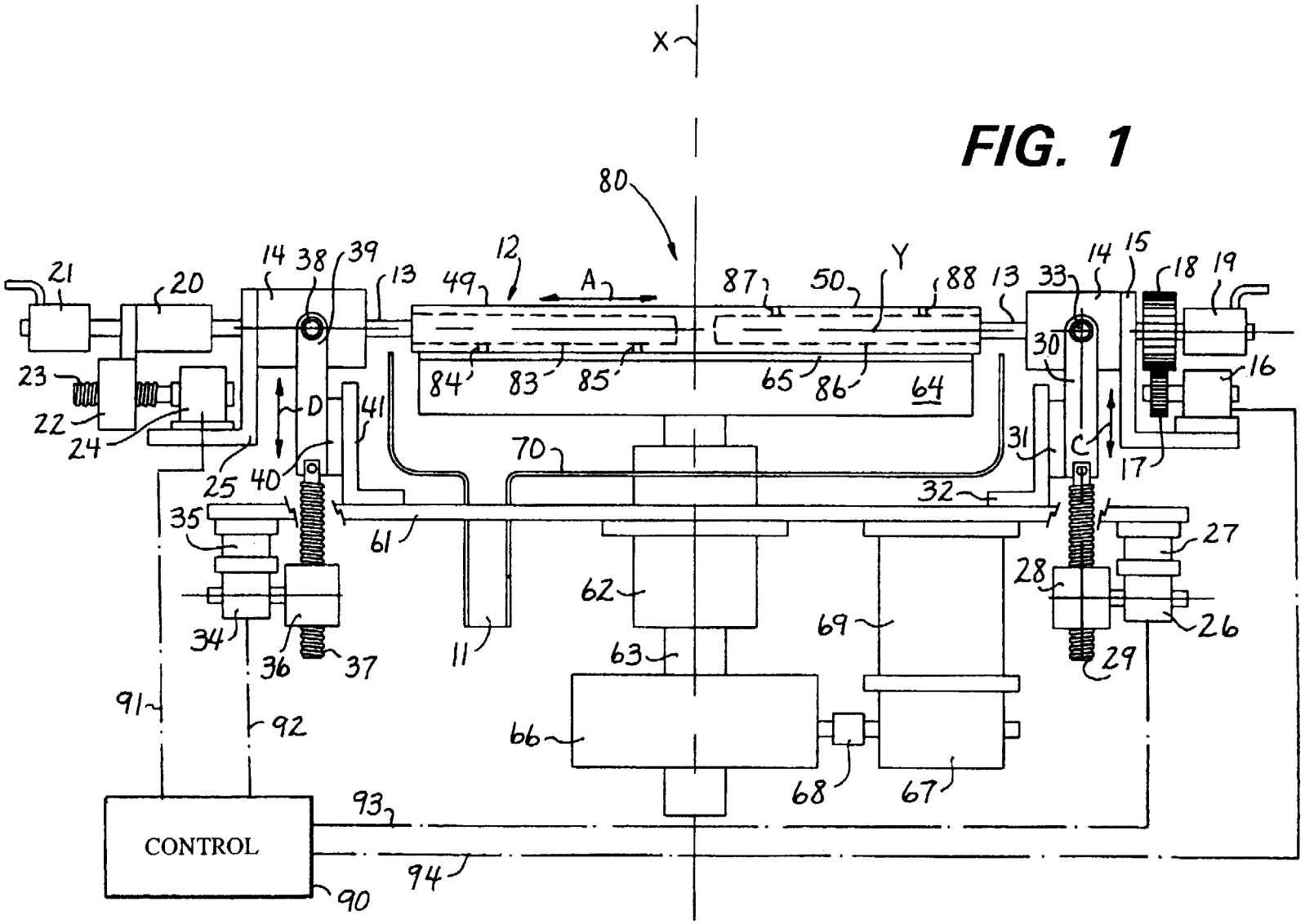
FIG. 1 is a front elevation view illustrating polishing pad conditioning apparatus constructed in accordance with the principles of the invention.
Figure 2:
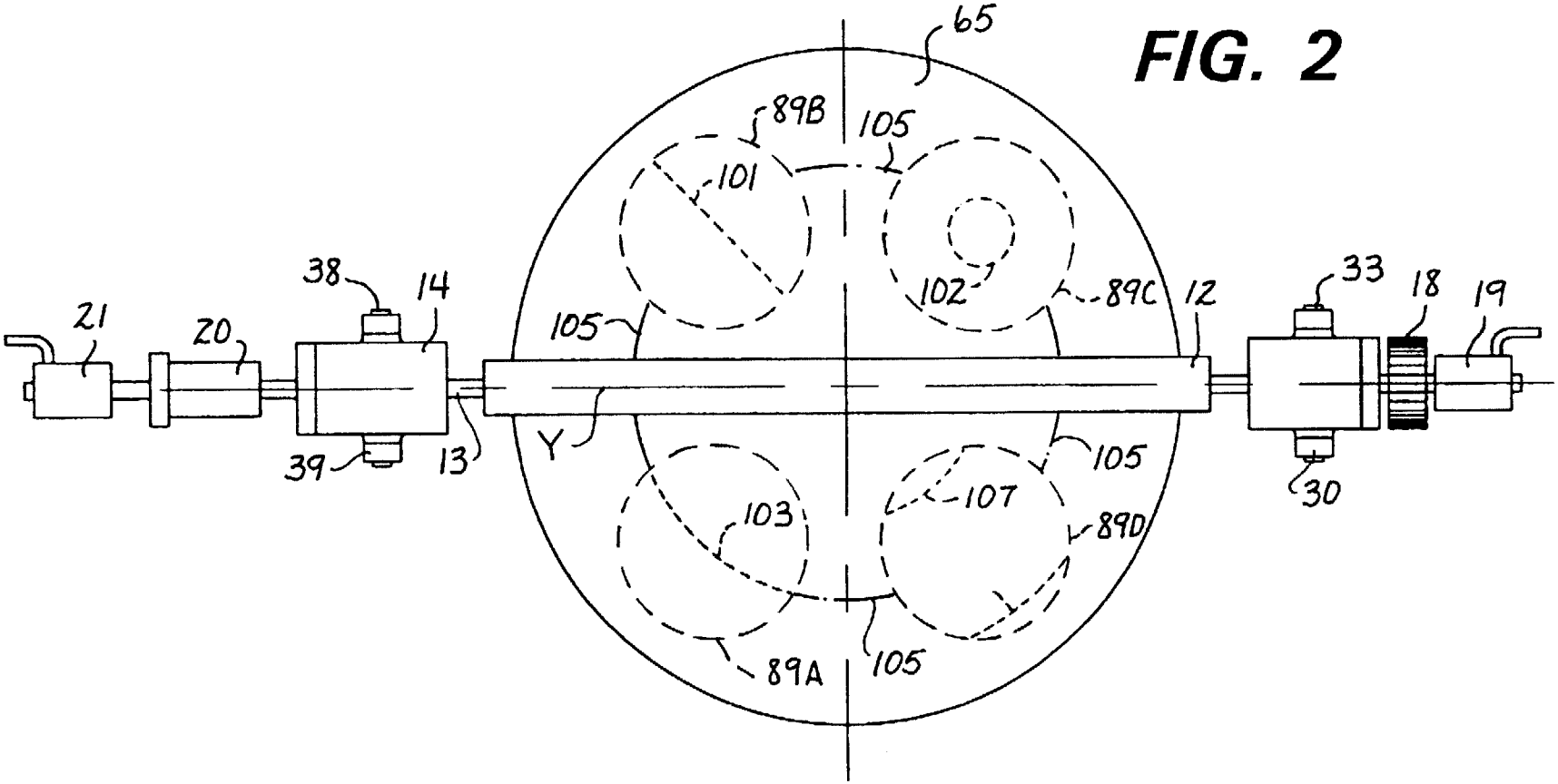
FIG. 2 is a top view illustrating the pad conditioning apparatus of FIG. 1 and showing additional construction details thereof.
Figure 3:
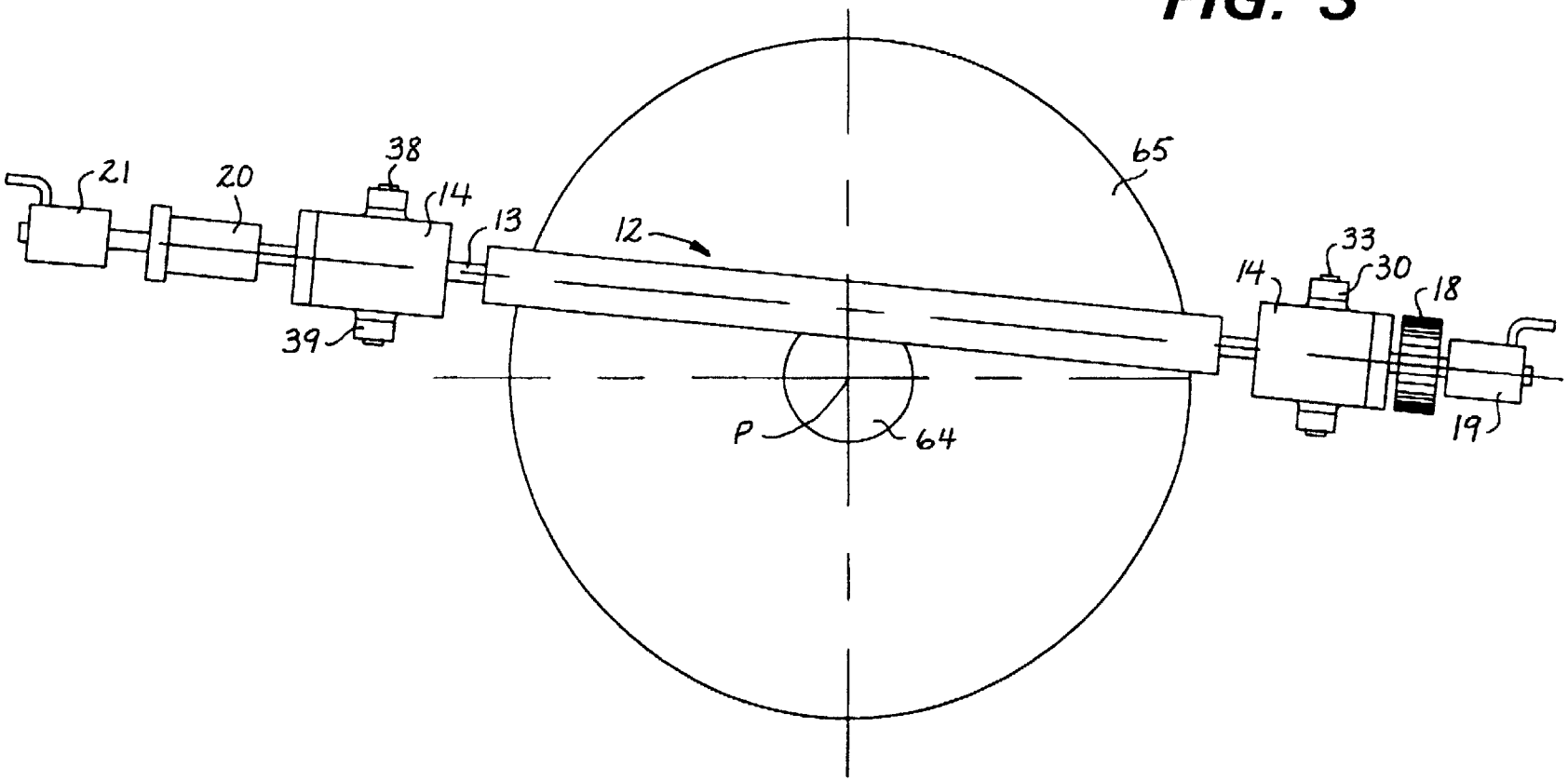
FIG. 3 is a top view illustrating the pad conditioning apparatus of FIG. 1 and showing an alternate orientation of the apparatus with respect to a polishing pad being conditioned by the apparatus.

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 to 3 illustrate polishing pad apparatus including a substantially rigid rectangular horizontally oriented steel plate 61 which extends down to and set on the ground. Plate 61 also extends under and outwardly from table or platin 64. Sleeve 62 supports rotatable shaft 63. Sleeve 62 includes the usual seals, bearings, and/or bushings found in conventional sleeves which support and permit the rotation of cylindrical shafts 63. Circular polishing pad 65 is affixed to or otherwise secured in position on the upper surface of cylindrical platin, table, or plate 64. Gearbox 66 mounted on shaft 63 is driven by cylindrically shaped motor 67 via a shaft and coupling 68. The motor 67 is fixedly mounted on frame 61 by L-shaped bracket 69. Motor 67 can be a single speed motor, but is preferably a variable speed, bi-directional motor. Particulate and liquids flowing off of pad 65 are captured by wet sink 70 and are flushed from sink 70 down drain 11 to a storage tank or other location.

The conditioning apparatus of the invention is generally indicated by reference character 80 and includes L-shaped brackets or feet 32, 41 which are secured to the frame 61 with bolts, adhesive, welding, or any other desired means. Securing conditioning apparatus 80 to the frame 61 which receives and supports shaft 63 and platin 64 is important and facilitates use of the apparatus 80 to remove runout and produce polishing surfaces on pad 65 which are uniformly canted and not canted with respect to axis X at each point on the polishing surface which is equidistant from axis X. For example, the apparatus 80 is often utilized to produce a flat surface which is, regardless of the angle between axis X and platin 64, perpendicular to axis X. By way of another example, each point on the cone shaped polishing surface 81 (FIG. 7) which is equidistant from axis X is also equidistant from an imaginary plane 82 normal to axis X.

Elongate cylindrical tool 12 has circular cross-sectional areas of uniform diameter and area at each point along the longitudinal axis of tool 12. The cross-sectional areas are each normal to axis Y. In FIG. 1, tool 12 is positioned to remove material from pad 65 to produce a flat, planar polishing surface with little or no runout. Tool 12 is concentrically fixedly mounted on hollow shaft 13. Each end of shaft 13 passes through a rotary/linear spindle bearing 14. One end of shaft 13 also passes through toothed gear 18 and into shaft coupling 19. Gear 18 is fixedly secured to shaft 13. When tool 12 is imperforate or porous, coupling 19 allows fluids, gases, or a vacuum to be applied to tool 12 through a channel 13A (FIG. 4) formed in shaft 13. Gear 17 meshes with gear 18 and is connected to motor 16. Motor 16 turns gears 17 and 18 and, consequently, shaft 13 and tool 12 mounted on shaft 13. Motor 16 is preferably, but not necessarily, a variable speed, variable direction motor which can provide performance information to a microprocessor control 90 which controls motor 16 and/or the rotation of spindle 63. Motor 16 is fixedly secured to L-shaped bracket 15. Bracket 15 is fixedly secured to bearing 14. Microprocessor control 90 can also, if desired, index or rotate spindle through an arc less than 360 degrees to one of a plurality of fixed positions so that tool 12 is in fixed position and a selected portion of tool 12 contacts a polishing pad 65. For example, when tool 12 is indexed to a first position, cutting teeth on tool 12 can contact pad 65. When tool 12 is indexed to a second position, a sandpaper-like abrading surface on tool 12 can contact pad 65.

The other end of shaft 13 passes through a rotary/linear spindle bearing 14, through shaft spindle 20, and through coupling 21. Coupling 21 allows fluids, gasses, or a vacuum to be applied to tool 12 through a channel 13A formed in shaft 13. Coupling 21 can be utilized separately or simultaneously with coupling 19. Spindle 20 permits shaft 13 to rotate freely, but can linearly displace shaft 13 through bearings 14 in the direction of arrows A when motor 24 rotates screw 23 to displace bracket/drive nut 22 and, consequently, spindle 20. Motor 24 is connected to bearing 14 by L-shaped bracket 35. Motor 24 can, like the other motors utilized in the apparatus of FIG. 1, be a single speed uni-directional motor, but is preferably a variable speed, bi-direction motor. Motor 24 preferably provides performance information to a microprocessor control 90 which controls motor 24 and/or the linear displacement of shaft 13. The performance information can pertain to the operation of the motor 24, the displacements of shaft 13, and/or any other desired information.

In FIG. 1, the vertical elevation of each end of shaft 13 and tool 12 can be altered by vertical drive systems. One vertical drive system includes variable speed, variable direction motor 26 mounted on and connected to plate 61 by block 27. Motor 26 turns drive nut 28 to vertically displace screw 29 up or down. Screw 29 is connected to yoke 30 which is pivotally connected to bearing 14 by pin 33. Block 31 is slidably attached to bracket 32 and fixedly connected to yoke 30 such that when yoke 30 is vertically displaced in the direction of arrow C, block 31 slides over bracket 32 and is simultaneously vertically displaced with yoke 30.

The other vertical drive system includes variable speed, variable direction motor 34 mounted on and connected to plate 61 by block 35. Motor 34 turns drive nut 36 to vertically displace screw 37 up or down. Screw 37 is connected to yoke 39 which is pivotally connected to bearing 14 by pin 38. Block 40 is slidably attached to bracket 41 and fixedly connected to yoke 39 such that when yoke 39 is vertically displaced in the direction of arrow D, block 40 slides over bracket 41 and is simultaneously vertically displaced with yoke 39. Motors 34, 26 or other sensors can provide microprocessor control 90 with performance information pertaining to the elevation (vertical displacement) of each end of shaft 13, the operation of the motors 34, 26, or any other desired information. Sensors can be provided which independently monitor and provide microprocessor control 90 with information concerning the speed of rotation of shaft 13, the direction of rotation of shaft 13, the lateral displacement of shaft 13 by screw 23, and the canting of shaft 13 by screws 29, 37. Such sensors can provide input which permits control 90 to turn tool 12 to any of a plurality of positions in which tool 12 remains in fixed position with respect to a pad 65.

As noted, coupling 21 permits fluids, gases or a vacuum to be applied through a channel 13A (not visible in FIG. 1) formed in shaft 13. Channel 13A interconnects coupling 21 with hollow 83 and openings 84, 85 formed in cylindrical tool 12. Openings 84, 85 each extend from hollow 83 to the outer surface of tool 12. Similarly, coupling 19 permits fluids, gases, or a vacuum to be applied through channel 13A (not visible in FIG. 1) formed in shaft 13 to interconnect coupling 19 with hollow 86 and openings 87, 88 in tool 12. Openings 87, 88 each extend from hollow 86 to the outer surface of tool 12. Consequently, coupling 19 permits one half 50 of tool 12 to be utilized independently of the other half 49 of tool 12. Coupling 21 permits the other half 49 of tool 12 to be utilized independently of the half 50 of tool 12 in fluid communication with coupling 19. A single continuous hollow can be utilized in place of the pair of separate hollows 83, 86 shown in FIG. 1.

FIG. 2 illustrates how tool 12 in FIG. 1 is positioned directly above and contacting a diameter line of pad 65.

FIG. 3 illustrates how tool 12 can be positioned above and contact a line which traverses pad 65 and which does not pass through the center point P of pad 65. Reference character 64 indicates a central area of pad 65. In FIG. 3, area 64 is not conditioned by tool 12 since tool 12 is offset slightly from center point P. As indicated in FIG. 2, pad 65 can, if desired, polish one or more semiconductor wafers 89A to 89D at the same time pad 65 is conditioned with tool 12.

Control 90 preferably includes a keyboard or other means for inputting information or signals into the control program of a microprocessor or other control apparatus to control the RPM and operation of motors 34, 26, 24, and 16 to rotate shaft 13, vertically displace the ends of shaft 13, in the directions of arrows C and D, and laterally displace shaft 13 in the directions of arrows A.

In use, motor 67 is operated to rotate shaft 63, platin or table 64, and pad 65 mounted on platin 64. Control 90 is utilized to operate motor 16 to rotate tool 12 at desired speeds or to rotationally index tool 12 to any of a plurality of fixed positions with respect to pad 65. Control 90 is then utilized to operate motors 26 and 34 to lower tool 12 into contact with rotating pad 65. Cutting teeth or edges on tool 12 remove material from pad 65 to produce a flat circular polishing surface which is normal to axis X. Tool 12 can also be utilized to produce a contoured polishing surface on pad 65.

Figure 4:
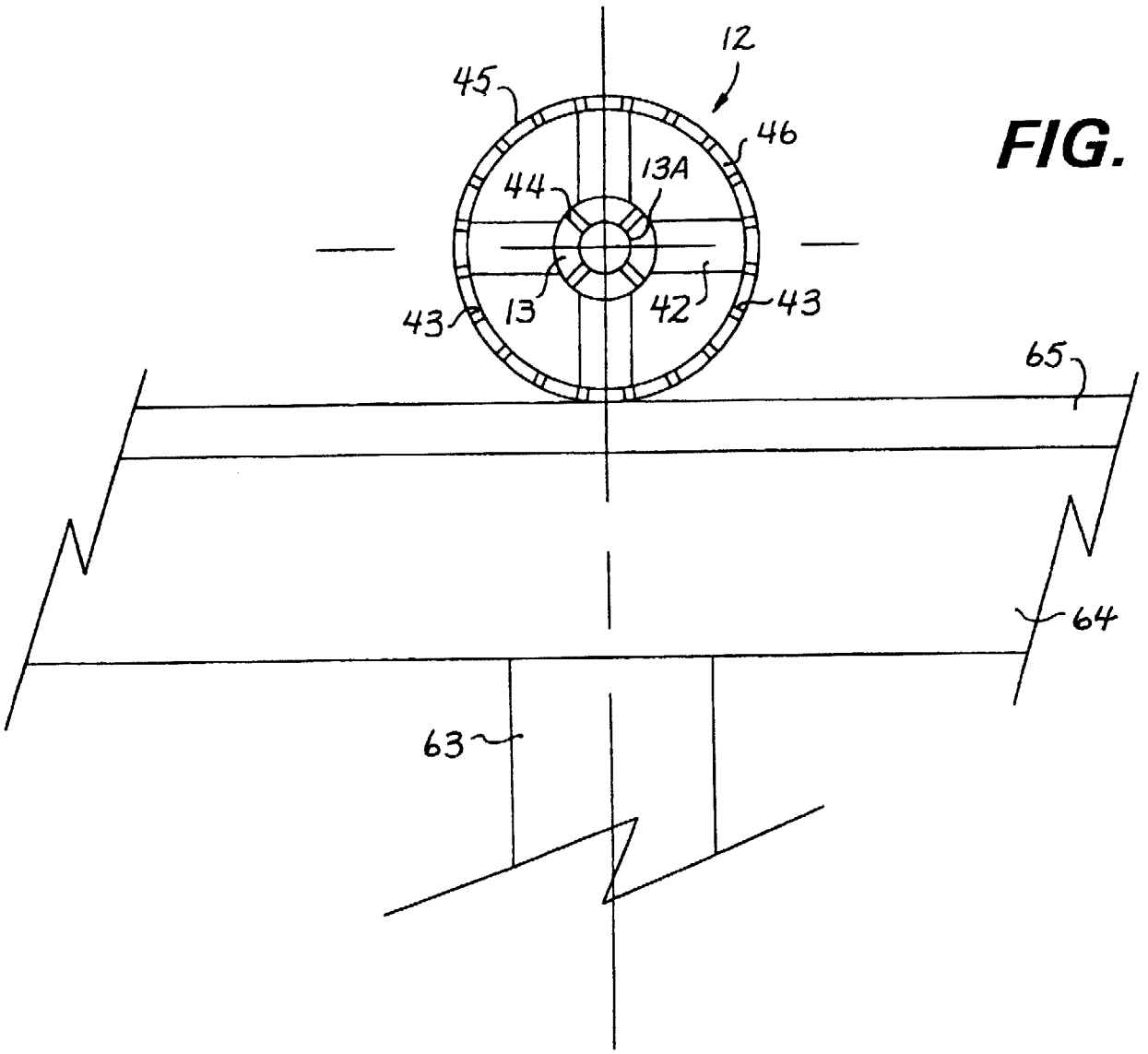
FIG. 4 is a side elevation view of the apparatus of FIG. 1 illustrating additional construction details of the conditioning cylinder utilized to condition the polishing surface of a pad.

In FIG. 4, the outer surface of hollow cylindrical tube 46 of a tool 12 is coated with diamonds or other abrasive material 45. Elongate webs or ribs 42 attach tube 46 to hollow shaft 13. Shaft 13 extends completely through tool 12. Perforations or openings 43 are formed through tube 46. If desired, shaft 13 can be bifurcated by a divider at the center of shaft 13 such that fluid entering one end of shaft 13 and tool 12 is prevented from flowing to the opposing end of tool 12. Perforations or openings 44 are formed through shaft 13. A pressurized liquid or gas flowing through channel 13A in tube 13 can flow out through openings 44 and 43 onto pad 65 to facilitate the conditioning of pad 65 by tool 12. A vacuum can be generated in channel 13A of tube 13 to draw liquids and gases, or even slurries, into tube 13.

Figure 5:
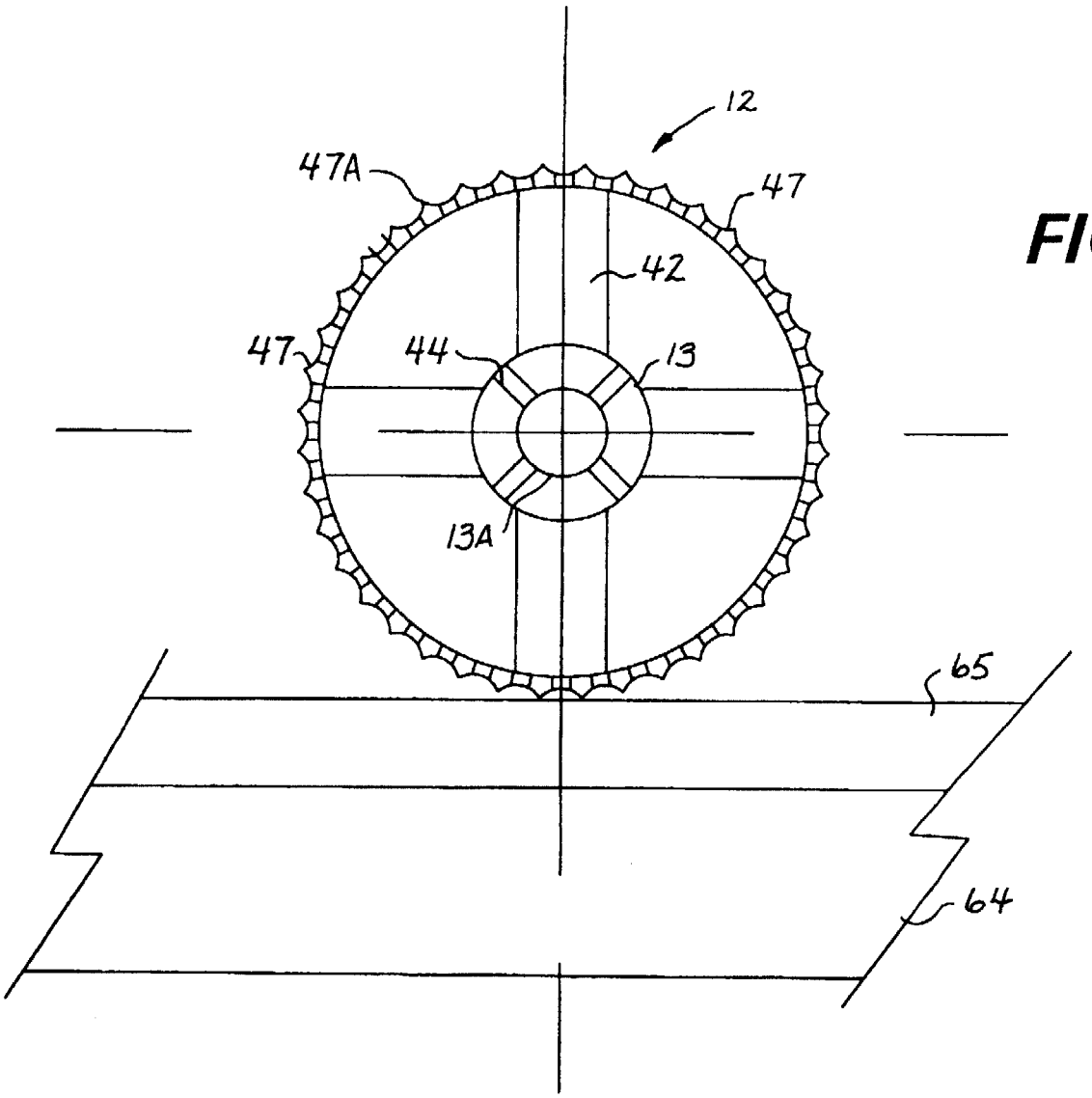
FIG. 5 is a side elevation view illustrating an alternate conditioning cylinder which can be utilized in the apparatus of FIG. 1.

An alternate embodiment of tool 12 is illustrated in FIG. 5 and includes a plurality of parallel arcuate grooves 47. Grooves 47 each run the length of tool 12. Each groove 47 is straight or spirals around the cylindrical surface of tool 12. Linear or spiral edges 47A cut and/or scrape pad 65. Abrasive material can, if desired, be applied to the outer surface of the tool depicted in FIG. 5. When edges 47A have a spiral shape, tool 12 and pad 65 can be rotated simultaneously at speeds which will cause spiral cuts or grooves to be formed in pad 65. Similarly, if pad is rotated and tool 12 is not, laterally displacing tool 12 in the direction of one of arrows A in FIG. 1 while pad 65 rotates will (regardless of whether edges 47A are linear or spiral) form spiral cuts or grooves in pad 65. As would be appreciated by those of skill in the art, a tool 12 with one (or more) cutting teeth can be utilized to form a spiral groove in pad 65 simply by displacing tool 12 laterally in the direction of one of arrows A while pad 65 rotates. Adjusting the speed of movement or rotation of tool 12 with respect to the speed of rotation of pad 65 will determine the shape of the spiral grooves formed in pad 65.

Figure 6:
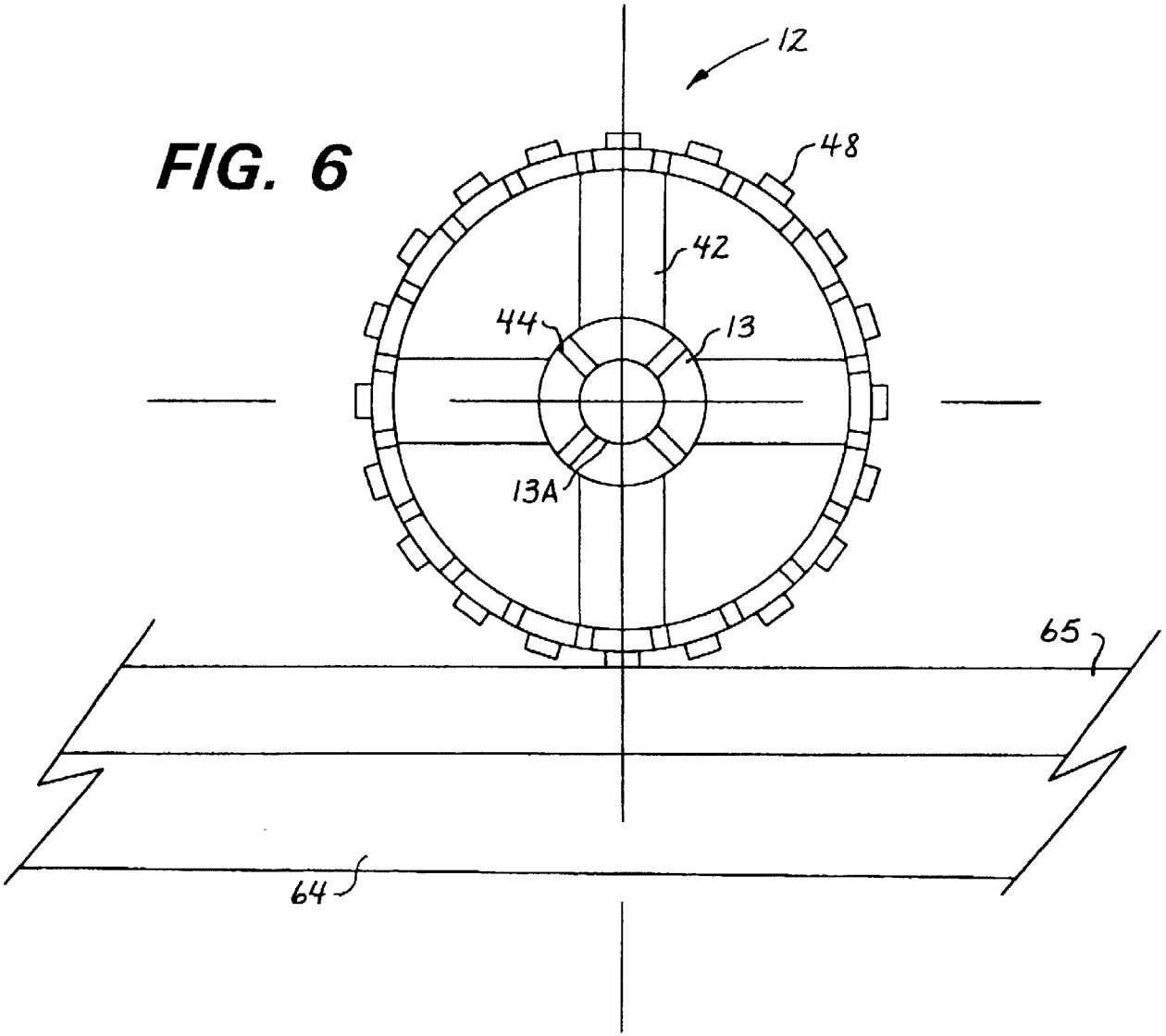
FIG. 6 is a side elevation view illustrating still another alternate conditioning cylinder which can be utilized in the apparatus of FIG. 1.

A further embodiment of tool 12 is illustrated in FIG. 6 and includes hardening cutting bits 48 attached to the outer surface of tool 12. Bits 48 can be shaped as desired and can be straight, spiral, etc.

Figure 7:
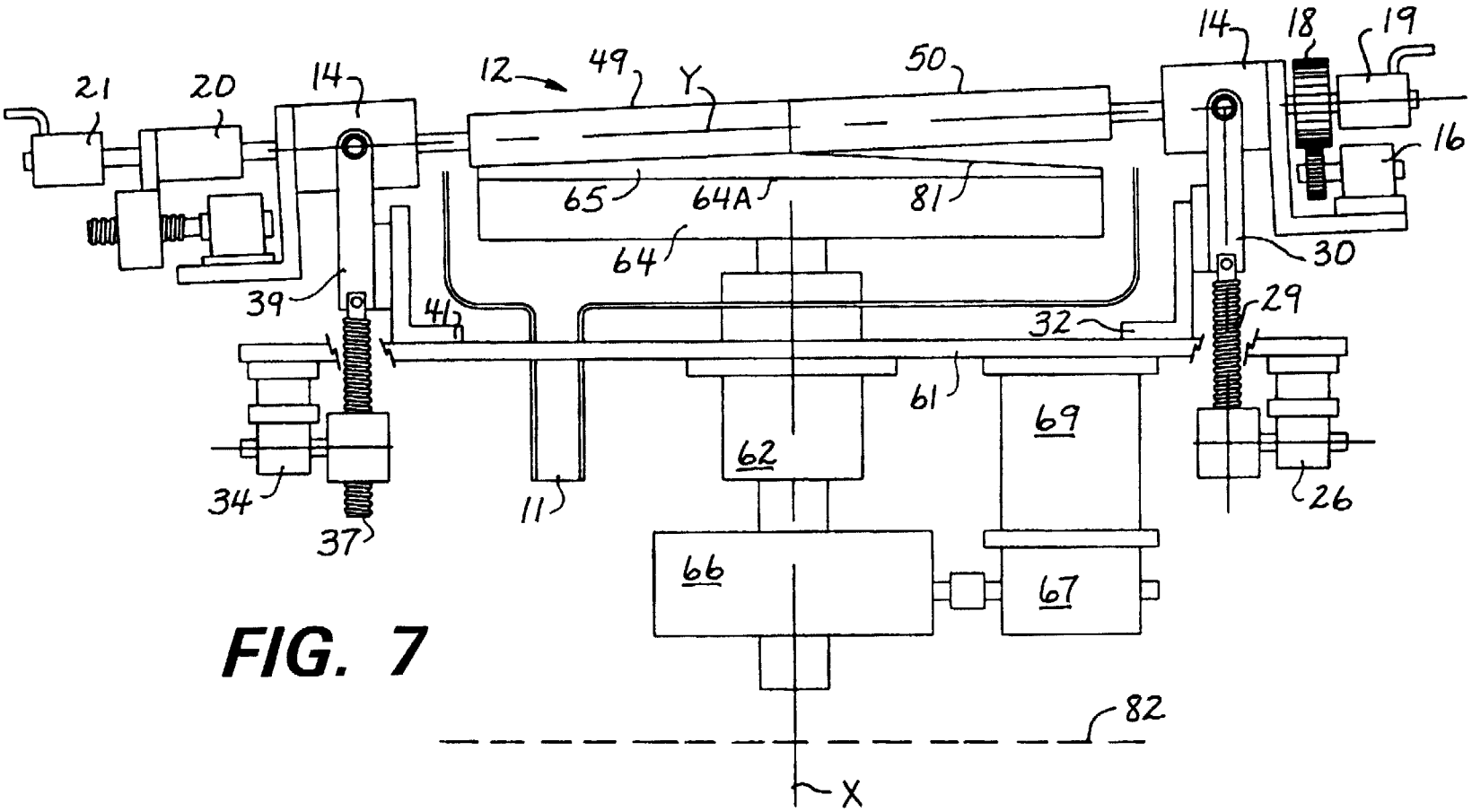
FIG. 7 is a side elevation view illustrating the apparatus of FIG. 1 illustrating the mode of operation thereof.

In FIG. 7, screws 29 and 37 are turned with motors 26 and 34 such that the longitudinal axis Y of cylindrical tool 12 is canted with respect to the upper circular surface 64A of platin 64. As a result, tool 12 cuts or abrades pad 65 to form a conical surface 81. If desired, one half 49 of tool 12 can be provided with a different cutting material or surface than the other half 50 of tool 12. For example, surface 49 can be configured to cut parallel grooves in pad 65 while surface 50 can be configured to uniformly roughen pad 65. Tool 12 can also be manipulated in the manner shown in FIG. 9B to produce a flat surface on a pad 65.

Figure 8A:
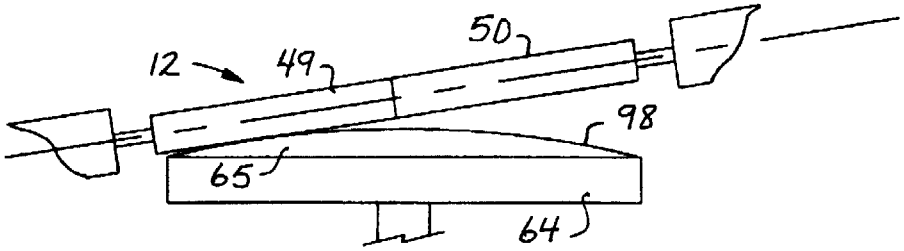
FIGS. 8A to 8C are side elevation views of the apparatus of FIG. 1 illustrating the mode of operation thereof to form an arcuate convex and/or "positive sphere" polishing surface on a polishing pad.
Figure 8B:
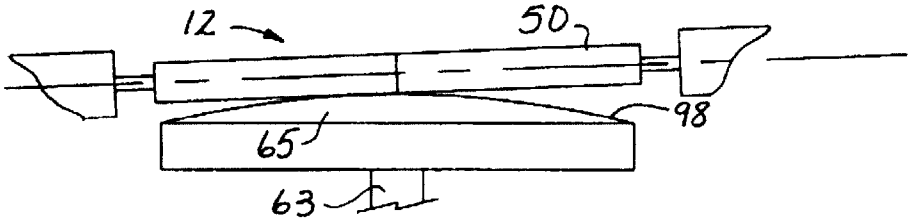
Figure 8C:
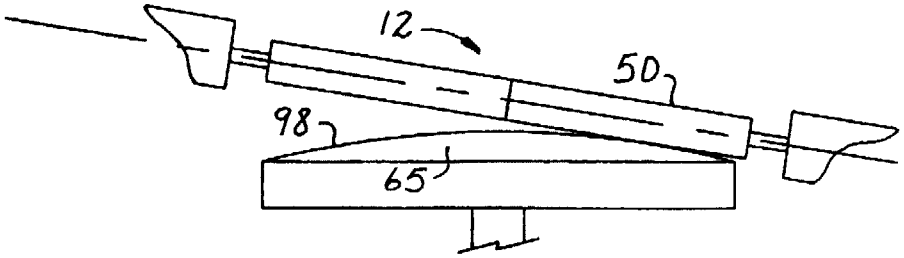

FIGS. 8A to 8C illustrate the use of cylindrical tool 12 to form a spherical surface on pad 65. In order to produce spherical surface 98 on a pad 65, motors 26, 34 are operated by control 90 to continuously alter the orientation of tool 12 from the position shown in FIG. 8A to the position shown in FIG. 8B, or, from the position shown in FIG. 8B to the position shown in FIG. 8C. As would be appreciated by those of skill in the art, only half 49 or half 50 of tool 12 is required to produce spherical surface 98. By way of example, and not limitation, half 49 can be utilized to produce spherical surface 98 and half 50 can be utilized to form parallel concentric grooves in the spherical surface 98 formed by half 49. As would further be appreciated by those of skill in the art, the arcuate pad contours illustrated in the drawings are exaggerated for the sake of clarity. In a typical polishing application, while the center of conical surface 81 might be one-sixteenth to one-eighth of an inch higher at the center than at the outer edge of pad 65, the difference in elevation between the center and outer edge of pad 65 could be also be less than 0.002 inch.

Figure 9A:
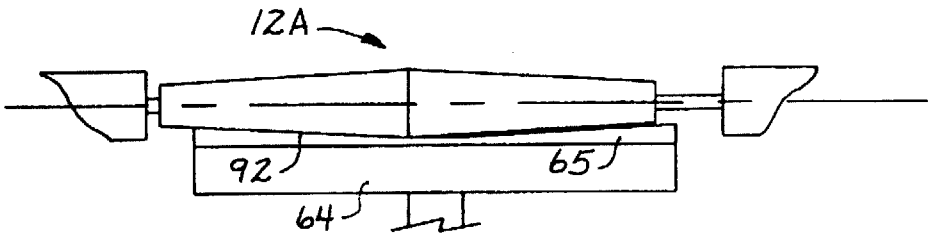
FIGS. 9A to 9C are side elevation views illustrating the use of a tapered conditioning cylinder to form various contoured polishing surface on a polishing pad, including the positive doughnut shape shown in FIG. 9C.

In FIG. 9A, a tapered tool 12A is utilized to form a concave surface 92 in a pad 65. As noted earlier with respect to FIG. 1, a tool 12 can be laterally or longitudinally displaced in the direction of arrow A during the contouring of a pad 65.

Figure 9B:
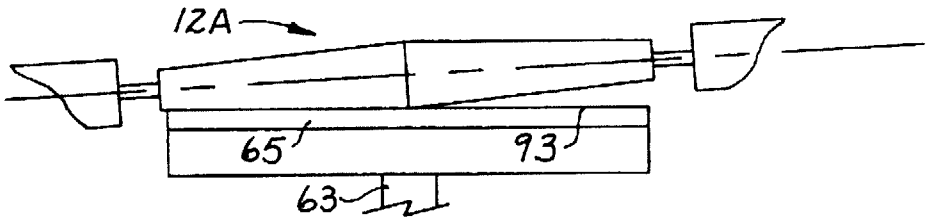

In FIG. 9B, a tapered tool 12A is utilized to form a flat surface 93 on a pad 65.

Figure 9C:
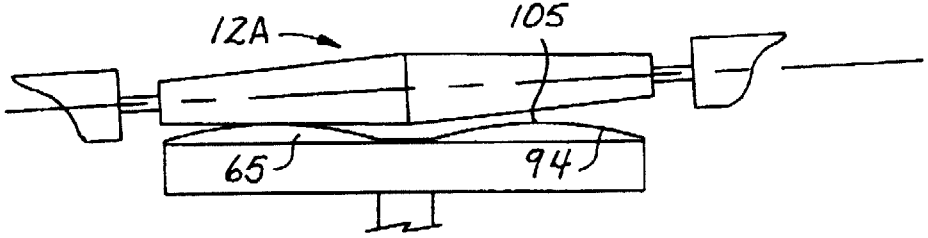

In FIG. 9C, a tapered tool 12A is utilized to form a doughnut shaped surface 94 on a pad 65. In order to form surface 94, tool 12A must be continuously canted through successive different orientations in a manner similar to the way tool 12 is canted in FIG. 8 to form spherical surface 98.

Figure 10:
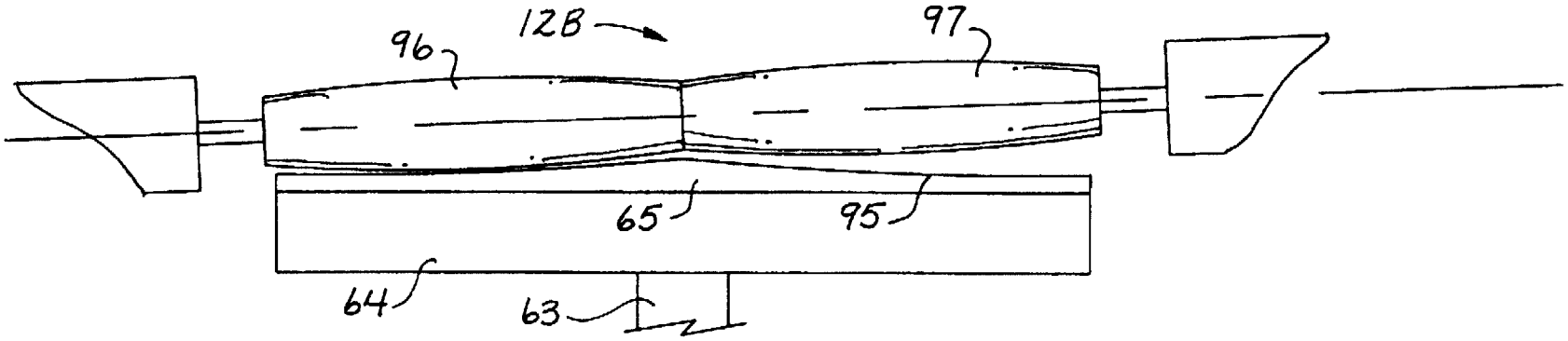
FIG. 10 is a side elevation view illustrating the use of a contoured conditioning cylinder to form a "negative doughnut" polishing pad surface having a raised center area; and, FIG. 11 is a side elevation view illustrating the use of a tapered conditioning cylinder to form a convex "positive sphere" polishing pad surface.

In FIG. 10, a tool 12B with a pair of convex lobes 96, 97 is utilized to form a concave conical surface 95. The surface 95 is formed by continuously canting tool 12B through successive different orientations in a manner similar to the way tool 12 is canted in FIG. 8 to form spherical surface 98. Alternatively, shaft 13 can be maintained in a perfectly horizontal orientation (parallel to the plane of the pad or platin) while tool 12B is vertically displaced against vertically oriented pad 65 to form a polishing surface which conforms to tool 12B.

Figure 11:
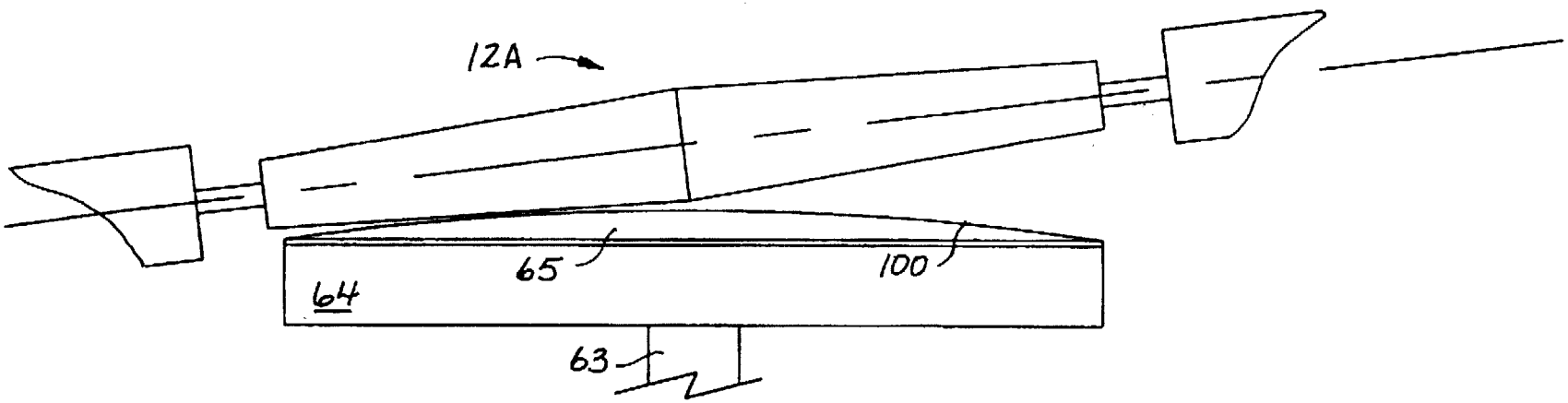

In FIG. 11, a spherical surface 100 is formed on a pad 65 by continuously canting tool 12A through successive different orientations in a manner similar to the way tool 12 is canted in FIG. 8 to form spherical surface 98.

Tools 12, 12A, 12B can, if desired, be utilized to condition a pad 65 while the pad is being used to polish a semiconductor wafer or other material.

The conical polishing surface 81 produces a higher polishing pressure across a wafer 89 along a line 101 (FIG. 2) which is at right angles to the direction of rotation of the polishing pad 65. Such a pressure distribution might facilitate the production of a flatter wafer.

The spherical polishing surfaces 98 and 100 in FIGS. 8 and 11 produce a higher polishing pressure in the center 102 of a wafer 89 (FIG. 3).

The doughnut polishing surface 94 of FIG. 9C moves the high pressure along a line 103 on a wafer 89A which is at about ninety degrees to the high pressure line 101 produced by a conical polishing surface 81. In FIG. 3 the highest point on a doughnut surface 94 is indicated by dashed line 105.

The inverted doughnut polishing surface 95 produces higher pressure areas 106 and 107 along the edges of a wafer and permits slurry to more easily access the center of a wafer 89.

A negative spherical pad surface (surface 98 is a positive spherical surface) is produced utilizing a single lobe 96 cutting tool which is long enough to extend completely across a pad 65. Such a pad surface would produce high pressure extending completely around the peripheral edge surface of a flat, circular semiconductor wafer.

The apparatus of the invention can be utilized on polishing pads which directly contact a wafer and can be utilized on "under" or support pads which are positioned intermediate the platin and the polishing pads.

Having described my invention in such terms as to enable those skilled in the art to understand and practice it, and having described the presently preferred embodiments thereof, I claim:

1. In combination with a polishing pad apparatus including a table having an upper surface, polishing pad means mounted on said upper surface of said table, said polishing pad means having an upper polishing surface, frame means to rotatably support said table in a selected orientation with respect to said frame means to rotate about a rotational axis substantially normal to said upper surface of said table, and means for rotating said table about said axis, the improvement comprising conditioning means to cut said pad means, said conditioning means comprising (a) an elongate tool for cutting said upper polishing surface, said tool having a longitudinal axis and first and second ends; and, (b) mounting means for attaching said tool to said frame means such that the elevation of at least one end of said tool can be adjusted to cant said longitudinal axis and said tool with respect to said rotational axis at a plurality of angles other than ninety degrees to cut said upper polishing surface.

2. The apparatus of claim 1 wherein said tool includes a cutting face which is generally conically shaped.

3. The apparatus of claim 1 wherein said tool includes a cutting face which is generally cylindrically shaped.

4. The apparatus of claim 1 wherein said mounting means holds said tool in fixed orientation while said tool cuts said upper polishing surface.

5. In combination with a polishing pad apparatus including a table having an upper surface, polishing pad means mounted on said upper surface of said table, said polishing pad means having an upper polishing surface, frame means to rotatably support said table in a selected orientation with respect to said frame means to rotate about a rotational axis substantially normal to said upper surface of said table, and means for rotating said table about said axis, the improvement comprising conditioning means to cut said pad means, said conditioning means comprising (a) an elongate tool for cutting said upper polishing surface, said tool having (i) a longitudinal axis, (ii) first and second ends, and, (iii) an arcuate geometric cutting face spaced apart from and extending along said longitudinal axis; and (b) mounting means for attaching said tool to said frame means such that said tool can be adjusted between at least (i) a first operative position with said longitudinal axis and said tool canted at a first angle with respect to said rotational axis to cut said upper polishing surface, and (ii) a second operative position with said longitudinal axis and said tool canted at a second angle with respect to said rotational axis to cut said upper polishing surface, said first angle being different than said second angle.

6. The apparatus of claim 5 wherein said face is generally conically shaped.

7. The apparatus of claim 5 wherein said face is generally cylindrically shaped.

8. The apparatus of claim 5 wherein said mounting means holds said tool in fixed orientation while said tool cuts said upper polishing surface.

9. In combination with a polishing pad apparatus including a table having an upper surface, polishing pad means mounted on said upper surface of said table, said polishing pad means having an upper polishing surface, frame means to rotatably support said table in a selected orientation with respect to said frame means to rotate about a rotational axis substantially normal to said upper surface of said table, and means for rotating said table about said axis, the improvement comprising conditioning means to cut said pad means, said conditioning means comprising (a) a tool for cutting said upper polishing surface, said tool having (i) a longitudinal axis, (ii) first and second ends, and, (iii) an arcuate geometric cutting face spaced apart from and extending along said longitudinal axis; and (b) mounting means for attaching said tool to said frame means such that said tool can be positioned to cut material from said upper polishing surface of said polishing pad, said cutting face removing material from said upper polishing surface to shape said polishing surface into an arcuate geometric surface.

10. The apparatus of claim 9 wherein said face is generally conically shaped.

11. The apparatus of claim 9 wherein said face is generally cylindrically shaped.

12. The apparatus of claim 9 wherein said mounting means holds said tool in fixed orientation while said tool cuts said upper polishing surface.

13. In combination with a polishing pad apparatus including a table having an upper surface, polishing pad means mounted on said upper surface of said table, said polishing pad means having an upper polishing surface, frame means to rotatably support said table in a selected orientation with respect to said frame means to rotate about a rotational axis substantially normal to said upper surface of said table, means for rotating said table about said axis, the improvement comprising conditioning means to cut said pad means, said conditioning means comprising (a) a tool for cutting said upper polishing surface, said tool having a longitudinal axis and first and second ends; and, (b) mounting means for attaching said tool to said frame means such that the elevation of each of said first and second ends of said tool can be moved between at least two different elevations at which said tool can cut said upper polishing surface.

14. The apparatus of claim 13 wherein said tool has a cylindrical cutting face circumscribing said longitudinal axis.

15. The apparatus of claim 13 wherein said mounting means holds said tool in fixed orientation while said tool cuts said upper polishing surface.

16. The apparatus of claim 13 wherein said tool has a conical cutting face circumscribing said longitudinal axis.

* * * * *